United States Patent [19]

Harwath

[11] 4,171,939

[45] Oct. 23, 1979

[54] ARRANGEMENT FOR MOUNTING A GEAR ON A SHAFT

[75] Inventor: Frank L. Harwath, Rockford, Ill.

[73] Assignee: Sundstrand Corporation, Rockford, Ill.

[21] Appl. No.: 890,877

[22] Filed: Mar. 27, 1978

[51] Int. Cl.[2] ..... F16B 3/00; F16D 1/06; F01C 1/10; F01C 21/00

[52] U.S. Cl. ..... 418/170; 418/270; 403/354; 403/355

[58] Field of Search ..... 418/70, 166–171, 418/182, 270; 403/345, 354–356

[56] References Cited

U.S. PATENT DOCUMENTS

| | | | |
|---|---|---|---|
| 982,895 | 1/1911 | Stoker | 418/182 |
| 1,541,435 | 6/1925 | Reller | 418/182 |
| 1,832,554 | 11/1931 | Holstein | 403/354 |
| 2,156,067 | 4/1939 | Rubinstein | 403/354 |
| 2,171,361 | 8/1939 | Gits et al. | 403/354 |
| 2,460,649 | 2/1949 | Muller | 418/206 |
| 2,659,313 | 11/1953 | Carson | 403/354 |
| 3,170,409 | 2/1965 | McLeod et al. | 418/171 |
| 3,240,154 | 3/1966 | Robbins | 418/70 |
| 3,424,019 | 1/1969 | Wolfram | 403/356 |

FOREIGN PATENT DOCUMENTS

| | | | |
|---|---|---|---|
| 2135861 | 2/1973 | Fed. Rep. of Germany | 418/166 |

*Primary Examiner*—John J. Vrablik
*Attorney, Agent, or Firm*—Ted E. Killingsworth; William R. Peoples; Michael B. McMurry

[57] ABSTRACT

An arrangement for mounting a gear on a drive shaft of a fuel pump includes a longitudinal slot dividing one end portion of the shaft into first and second cantilever sections. Shoulders formed in the slot on the cantilever sections abut a key extending transversly through the slot to protrude from the shaft and the key is received in keyways formed in the gear diametrically of each other and opening into a cylindrical aperture. The latter is sized to receive the inner end portion of the shaft with a press fit with end walls of the keyways abutting the protruding key to locate the shaft axially within the gear. The width of the slot separating the cantilever sections of the shaft is slightly greater than the diameter of the key thereby providing clearance between the key and the cantilever sections to allow deflection of the sections during press-fitting of the shaft in the gear.

5 Claims, 4 Drawing Figures

ARRANGEMENT FOR MOUNTING A GEAR ON A SHAFT

BACKGROUND OF THE INVENTION

The present invention relates generally to a fuel delivery unit and more specifically to a delivery unit which includes a gear pump for drawing oil from a supply and pumping the oil to a burner for combustion. More specifically, the invention relates to an arrangement for mounting a gear on a drive shaft of the fuel pump.

In one type of prior gear pump, an inner gear is fixed on a drive shaft and the resulting assembly is telescoped eccentrically into a larger diameter ring gear with a crescent disposed in the eccentrically created space between the gears. One example of a gear pump including a gear set of this type is disclosed in U.S. Pat. No. 3,307,569 wherein the inner gear is fixed on the drive shaft by means of a drive key or pin which extends through a radial bore in the gear to mate with a longitudinal slot formed in the shaft. Surrounding the ring gear is a stationary gear plate which is secured to a pump housing by means of a cover plate spaced slightly from the end of the shaft. With this arrangement, as the shaft is rotated torque is transmitted from the shaft and through the pin to rotate its gears and thereby pump oil.

A similar mounting arrangement is disclosed in U.S. Pat. No. 2,460,649 with the gear splined on a pin. The patent suggests that this arrangement is to allow the gear to move axially relative to the shaft thereby to avoid imparting thrust between the gear and the shaft.

In still another type of prior mounting arrangement, the gear may be mounted on the end of the shaft with a press fit so that drive from the shaft is transmitted to the gear through the press fit connection.

In each of the foregoing prior art arrangements, the useful service life of the fuel pump may be shortened due to wear in the pump between the drive shaft and the inner gear or as a result of oil leakage and wear between the gear set and the cover plate. This latter leakage and wear may be caused by contact between the end of the shaft should the shaft be forced accidently against the cover plate during handling, for instance. Moreover, inasmuch as such pump also typically uses the pumped oil as a lubricant, the wear between the moving parts of the gear pump may be greatly accelerated when pumping low lubricity fuel oils.

Primarily, the damaging wear is caused by relative motion between parts of the coupling such as may occur during starting or stopping of the pump and even during normal running. Additional wear also may be caused by the contamination resulting from earlier wear. In the connection between the inner gear and the shaft, the wear may be observed, for example, on the inside diameter of the inner gear, on the outside diameter of the shaft where it mates with the gear, and at the contact surfaces of the driving key or pin which may be used to transmit torque from the shaft to the gear. In those pumps where the gear is mounted on the shaft by means of a press fit, wear may be observed between the contact surfaces of the gear and the shaft if the torque transmitting capability of the press fit has been exceeded. As might be expected, once this wear begins between these surfaces, the gear may quickly loosen on the shaft thereby rendering the pump inoperative.

BRIEF SUMMARY OF THE INVENTION

The primary aim of the present invention is to provide a new and improved arrangement for mounting the inner gear of the pump on the drive shaft so as to virtually eliminate the possibility of damaging wear occuring between the shaft and the gear during normal use while also, maintaining clearance between the end of the shaft and the cover plate. A more detailed object is to achieve the foregoing in an arrangement which utilizes the simplification of a press-fit coupling and the torque transmitting capabilities of a keyed coupling but without having to achieve the close tolerances usually required of a press fit in order to avoid damaging the gear when pressing the gear on the shaft.

A further detailed object is to provide a greater tolerance range for the press fit between the shaft and the gear by forming the shaft to include a unique longitudinal slot dividing an inner end portion of the shaft upon which the gear is mounted into two cantilever halves.

The invention also resides in the unique inter-fitting relationship of key means coacting in an axial direction between the shaft and the gear to maintain axial clearance between the inner end of the shaft and the cover plate without, at least during normal operation of the pump, transmitting torque between the shaft and the gear. Moreover, in the event the torque transmitting capability of the press fit between the shaft and the gear is exceeded, the key means advantageously acts between the gear and the shaft to transmit the excessive torque without substantial slippage or wear in the press fit.

Still further, the invention resides in utilizing at least a section of the shaft slot as a portion of the key means whereby parts of the key means are oriented to reduce press-fit stresses in the gear adjacent a pin-receiving key-way in the gear.

These and other objects and advantages of the present invention will become more apparent from the following detailed description when taken in conjunction with the accompanying drawings.

DETAILED DESCRIPTION OF THE PREFERRED EMBODIMENT

Figure 1:
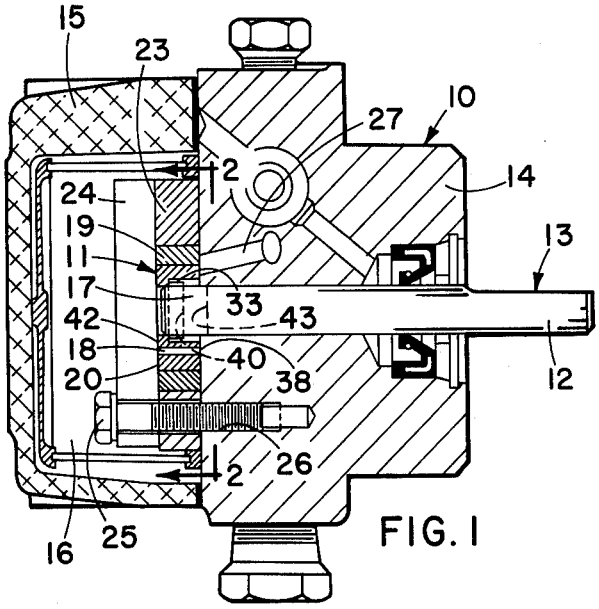
FIG. 1 is a cross-sectional view of a gear pump with a gear mounted on a drive shaft in accordance with the present invention.

As shown in the drawings for purposes of illustration, the present invention is embodied in a mounting arrangement particularly suited for use in a gear pump 10 to secure a member such as an inner gear 11 of the pump to a drive shaft 13. The general construction of such gear pumps is well known in the art and thus the pump 10 will be described only briefly herein. Accordingly and with reference to FIG. 1, it is seen that the pump 10 includes a housing 14 within which the drive shaft 13 is journaled with an outer end portion 12 protruding from one side of the housing. An end cap 15 is secured to the other side of the housing and defines a reservoir 16 for receiving fuel oil from a supply (not shown). Mounted on an inner end portion 17 of the drive shaft is the inner gear 11 whose peripheral teeth 18 (see Fig. 2) mate with inwardly extending teeth 22 of an eccentrically mounted ring gear 19. A crescent 20 is captivated in the space between the inner gear and the ring gear so that fluid may be drawn through an inlet passage (not shown) when the drive shaft 13 is rotated in the direction of the arrow 21 shown in FIG. 2. Surrounding the ring gear is a stationary gear plate 23 which is sandwiched between the housing 14 and a cover plate 24 (see FIG. 1). Three screws 25 secure the cover plate and gear plate to the housing by being threaded into suitable bores 26 in the housing. Oil pumped from the reservoir 16 is discharged through a passage 27 for eventual delivery to a burner (not shown).

In accordance with the primary object of the present invention, a simple yet unique arrangement secures the inner gear 11 on the drive shaft 13 so as to virtually eliminate relative movement between the gear and the shaft during normal service use and to keep the shaft from being forced axially within the gear to engage and wear against the cover plate 24. For these purposes, the inner end portion 17 of the shaft 13 is formed with a slot 29 (see FIG. 3) so that the shaft may be telescoped into the gear with a press fit through a greater range of tolerance variations without splitting the gear. In addition, key means coacting between the shaft and the gear serve to locate the inner end portion of the shaft within the gear so that clearance is provided and maintained between the inner end portion 17 of the shaft and the cover plate 24. With this arrangement, the torque between the gear and the shaft normally is transmitted through the press fit between the shaft and the gear but, if for some reason the pump should require torque beyond the capability of the press fit, the excessive torque is transmitted between the shaft and the gear by the key means. Normally, however, the key means serves to locate the shaft relative to the gear so that, should the outer end portion 12 of the shaft be forced axially accidently or otherwise toward the cover plate, any axial displacement is prevented by the action of the key means between the gear and the shaft.

In the present instance, the key means comprises two keyways 30 formed in the inner gear 11 and spaced diametrically of each other relative to an axial aperture 31 formed through the gear. A pin 33 is captivated within the slot 29 of the drive shaft 13 and is a length greater than the diameter of the shaft so that when the shaft is telescoped into the aperture 31 of the gear, the opposite ends of the pin 33 project into the keyways 30 thereby locking the gear against rotation on the shaft in the event the torque capability of the press fit is exceeded. More specifically, each of the keyways 30 includes a radially outward wall 34, two axially extending side walls 35 and a transverse end wall 36 (see FIG. 3.) Each keyway opens from one face 38 of the gear and the end wall 36 is located beyond the middle of the gear closer to the other face 42. The width or distance between the two side walls 35 of each keyway 30 is greater than the diameter of the pin 33, and the distance between the two radially outward walls 34 of the keyways as measured diametrically relative to the gear is greater than the length of the pin 33. Accordingly, when initially mounting the gear on the shaft 13, clearance exists between the outward walls and the opposite ends of the pin as well as between the side walls 35 and the pin (see FIG. 2).

Figure 2:
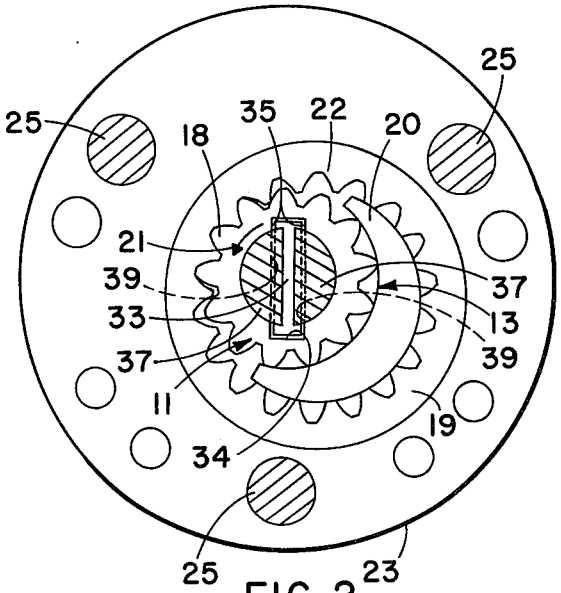
FIG. 2 is an enlarged cross-sectional view taken substantially along line 2—2 of FIG. 1.
Figure 3:
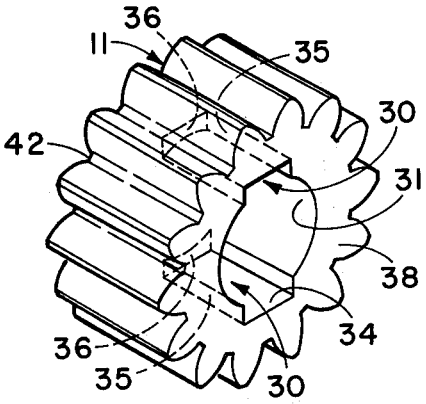
FIG. 3 is an exploded, fragmentary perspective view showing parts of the mounting in association with the gear and the shaft upon which the gear is to be mounted.

In considering that portion of the exemplary mounting arrangement which is formed directly in the drive shaft 13, it will be observed in FIGS. 2 and 3 that the slot 29 extends longitudinally of the shaft and divides the shaft diametrically into two cantilever sections 37. Inside walls 39 of the two cantilever sections define the sides of the slot 29 and a shoulder 40 is formed in each side wall for abutting engagement with the pin 33. From the shoulder, the narrowed section 41 of the slot 29 extends in an axial or longitudinal direction along the shaft terminating in an end wall 43 which is spaced a preselected distance from the inner end of the shaft. Normally, the distance between the side walls 39 of the cantilever sections 37, that is, the thickness of the slot, is greater than the thickness or diameter of the pin 33, being approximately equal to the distance between the side walls 35 of the keyways 30. Moreover, the length of the pin is greater than the width, that is, the diametrical length of the slot so that opposite ends of the pin protrude from the shaft to extend into the keyways 30. With this arrangement, the shoulders 40 tend to center the pin 33 within the slot 29 and thus leave a slight clearance between the pin and side walls 39 (see FIG. 2).

Figure 4:
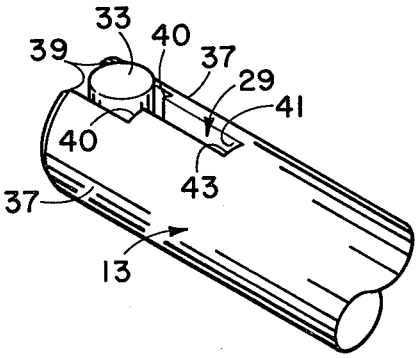
FIG. 4 is a fragmentary perspective view showing the gear held in assembled relation with the drive shaft by means of the mounting arrangement of the present invention.
Figure 4:
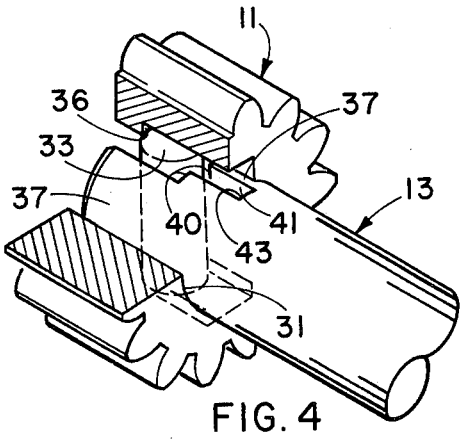

In addition, as shown in FIGS. 1 and 4, with the shaft 13 telescoped into the aperture 31 of the gear 11, stop means captivate the pin within the gear. More particularly, the opposite ends of the pin are abutted on one side by the end walls 36 of the keyways 30 and on the other side by the two shoulders 40 of the cantilever sections 37. Accordingly, the shaft is prevented from being forced in axial direction further toward the cover plate 24. Herein, the shoulders are located axially from the inner end of the shaft a preselected distance so that with the pin captivated between the shoulders and the end walls 36, the inner end of the shaft is spaced axially from the cover plate 24 (see Fig. 1). Additionally, the axial length of the slot 29 or more precisely that of the narrowed section 41, is such that the end wall 43 is located outside of the gear aperture 31. Accordingly, when inserting the shaft 13 into the aperture, the cantilever sections 37 may deflect slightly toward each other. By virtue of this, the tolerances required for a press fit in the exemplary mounting arrangement between the shaft and the gear need not be as restrictive as those normally required for press-fit couplings. To take advantage of this feature, it is important that clearance be provided between the pin 33 and the cantilever walls 39. Otherwise, the pin would keep the sections from deflecting toward each other. However, because of the clearance between the pin and the section walls 39, it will be appreciated that virtually all of the torque normally generated during operation of the pump is transmitted through the press fit between the shaft and the gear. Should an overtorque condition occur between the drive shaft 13 and the gear 11 and cause the shaft to slip within the gear, such slippage is necessarily limited by engagement of the protruding ends of the pin 33 with the keyway side walls 35, the excessive torque being transmitted by the pin 33 to the gear. Inasmuch as the exemplary gear pump 10 normally is driven in only one direction during service use, it will be appreciated that slippage resulting from torquing beyond the capability of the press fit occurs only one time so that thereafter relative movement between the gear and the shaft is virtually eliminated along with the excessive wear problems caused by such relative movement.

I claim:

1. An arrangement for mounting a member on one end portion of the rotatable shaft with a press fit comprising, a slot formed through said one end portion of the shaft and extending in a generally longitudinal direction relative thereto with sides of said slot opening in generally opposite directions from the shaft and having one end opening axially from said one end portion, first and second cantilever sections of said one end portion being defined by said slot, and key means coacting between the shaft and the member to keep one said end portion of the shaft from extending in one axial direction through the member beyond a preselected position with respect to said member, said key means comprising a key protruding in a generally radial direction from one of said shaft and member, and stop means formed on the other of said shaft and said member, said key abutting said stop means and thereby locating said shaft with respect to said member, said key means further including a key way formed in said member with said stop means including an end wall of said key way, said key comprising a pin located within said slot, said pin having a thickness less than the thickness of said slot and further having a length greater than the width of said slot, thereby to protrude into said key way and said stop means further including a shoulder formed on one of said cantilever sections and extending generally into said slot for abutting engagement with said pin.

2. An arrangement for mounting a member on a shaft as defined by claim 1 wherein said cantilever sections include fixed ends spaced from said member.

3. An arrangement for mounting a member on a shaft as defined by claim 2 wherein each of said cantilever sections includes one of said shoulders with said shoulders being spaced axially from said fixed ends.

4. An arrangement for mounting a gear having opposing side faces on one end portion of a generally cylindrical shaft for rotation with the shaft, said arrangement comprising a generally cylindrical aperture of a predetermined diameter extending axially through the gear from one face to the other, a keyway formed in said gear, said keyway opening in a generally radial direction from said aperture and extending from one face of said gear in a generally axial direction, an end wall of said keyway formed within said gear between said faces, said one end portion of said shaft including first and second cantilever sections and having a diameter slightly greater than said predetermined diameter of said aperture, a slot of preselected width formed through said shaft and extending in a generally longitudinal direction relative thereto, said cantilever sections being defined by said slot and telescoped into said aperture with a press fit, a shoulder formed on one of said cantilever sections and extending into said slot, and a key located generally within said slot and being captivated against movement in an axial direction relative to said gear by abutting engagement with said shoulder and said end wall, said key protruding from said slot partially into said keyway with clearance being provided between said key and said cantilever sections and between said key and said keyway whereby torque normally is transmitted between said gear and said shaft through the press fit between said shaft and said gear.

5. An arrangement for mounting a gear having opposing side faces on one end portion of a generally cylindrical shaft for rotation with the shaft, said arrangement comprising a generally cylindrical aperture of predetermined diameter extending axially through the gear from one face to the other, first and second keyways formed in said gear generally diametrically of each other, each of said keyways including radially outward walls relative to said aperture and extending from one face of said gear in a generally axial direction, an end wall of each of said keyways formed within said gear between said faces, said one end portion of said shaft including first and second cantilever sections and having a diameter slightly greater than said predetermined diameter of said aperture, a slot formed laterally through said shaft and having a preselected width, said cantilever sections being defined by said slot and telescoped into said aperture with a press fit from said one face of said gear, a shoulder formed on each of said cantilever sections and extending into said slot, and a generally cylindrical pin centered within said slot by abutting engagement with said shoulders, the length of said pin being greater than the diameter of said shaft but less than the diametrical distance between said radially outward walls of said first and second keyways, the diameter of said pin being less than the thickness of said slot between said cantilever sections thereby providing clearance between said sections and said pin, said pin being captivated against movement in an axial direction relative to said gear by abutting engagement with said end walls of said keyways whereby torque normally is transmitted between said gear and said shaft through the press fit between said shaft and said gear.

* * * * *